United States Patent [19]

Frauenknecht et al.

[11] Patent Number: 4,852,991

[45] Date of Patent: Aug. 1, 1989

[54] DYEING OF POLYAMIDE FIBERS WITH ANIONIC DYES USING A CATIONIC ASSISTANT FOLLOWED BY AN ANIONIC ASSISTANT

[75] Inventors: Josef Frauenknecht, Therwil; Dieter Schwer, Riehen, both of Switzerland

[73] Assignee: Sandoz Ltd., Basel, Switzerland

[21] Appl. No.: 163,443

[22] Filed: Mar. 3, 1988

[30] Foreign Application Priority Data

Mar. 4, 1987 [DE] Fed. Rep. of Germany ..... 3706887

[51] Int. Cl.[4] ..... D06P 3/06; D06P 1/60; D06P 5/02

[52] U.S. Cl. ..... 8/586; 8/531; 8/533; 8/534; 8/587; 8/604; 8/606; 8/905; 8/917; 8/924

[58] Field of Search ..... 8/598, 588, 606, 680, 8/586, 587

[56] References Cited

U.S. PATENT DOCUMENTS 3,740,345 6/1973 Berger ..... 8/580
4,191,532 3/1980 Gross et al. ..... 8/527
4,444,564 4/1984 Salathe et al. ..... 8/588
4,629,465 12/1986 Hasler et al. ..... 8/400

FOREIGN PATENT DOCUMENTS 2802304 7/1978 Fed. Rep. of Germany .
1045640 10/1966 United Kingdom .
1218715 1/1971 United Kingdom .

*Primary Examiner*—A. Lionel Clingman
*Attorney, Agent, or Firm*—Gerald D. Sharkin; Richard E. Vila; Thomas C. Doyle

[57] ABSTRACT

The invention relates to a process for dyeing synthetic or natural polyamide fibers with anionic dyestuffs, comprising (i) bringing the polyamide fibers into contact with an aqueous dyeing liquor which contains in addition to one or more dyestuffs a cationic dyeing assistant having affinity for anionic polyamide dyestuffs, and dyeing the polyamide fibers at a temperature of from 60° to 105° C., and (ii) adding an anionic dyeing assistant to the dyeing liquor 15 to 60 minutes after reaching the dyeing temperature, to complete the dye exhaustion. Surface and fibre level dyeings with a good dye penetration are thus obtained.

40 Claims, No Drawings

DYEING OF POLYAMIDE FIBERS WITH ANIONIC DYES USING A CATIONIC ASSISTANT FOLLOWED BY AN ANIONIC ASSISTANT

The present invention relates to a process for surface and fibre level dyeing of synthetic and/or natural polyamides with anionic dyestuffs.

As a natural product, wool can exhibit a strongly variable affinity for anionic dyestuffs, for example between wool fibres of different origin and for the wool fibre itself between its root and tip, thus leading to skittery dyeings. A further problem concerns the penetration and level distribution of the dyestuff into the textile substrate, particularly when such is thick or tightly spun, woven or knitted. Although various palliatives have been proposed, the colourist is still confronted with the problem of unlevel dyeings on synthetic and natural polyamides.

The process has been found that permits polyamide fibres to be dyed in level, non-skittery dyeings with a good dye penetration and without impairing the all-round fastnesses of the dyed polyamide fibres.

Accordingly, there is provided a process for dyeing synthetic or natural polyamide fibres with anionic dyestuffs, comprising (i) bringing the polyamide fibres into contact with an aqueous dyeing liquor which contains, in addition to one or more dyestuffs, a cationic dyeing assistant having affinity for anionic polyamide dyestuffs, and dyeing the polyamide fibres at a temperature of from 60° to 105° C., and (ii) adding an anionic dyeing assistant to the dyeing liquor 15 to 60 minutes after reaching the dyeing temperature, to complete the dye exhaustion.

According to the invention, a non-ionic dyeing assistant can be added either to the cationic dyeing assistant or to the anionic dyeing assistant or to both in an amount such that in the first dyeing step the cationic character still predominates and in the second dyeing step the anionic character still predominates.

By a cationic dyeing assistant having affinity for anionic dyestuffs is meant a cationic compound capable of forming an addition product with the anionic dyestuff and which has a retarding action on the anionic dyestuff, particularly at the dyeing temperature.

Suitable cationic dyeing assistants having affinity for anionic dyestuffs and retarding properties include polyglycol ethers of fatty amines, fatty polyamines, fatty acid amide-amines and fatty acid amide-polyamines, the fatty residue being saturated or unsaturated. By polyglycol ethers are meant addition products of ethylene oxide as well as the addition products of ethylene oxide and $C_3$ or $C_4$ alkylene oxides, optionally containing a minor proportion of styrene oxide. Such compounds may contain up to 200 ethylene-oxy and/or up to 100 $C_3$ or $C_4$ alkylene-oxy groups and optionally up to 5 styrene-oxy groups and may be used in their acid addition salt form or in their quaternized form. These compounds are known.

Preferred cationic dyeing assistants are:

a. those disclosed in GB Patent Specification No. 1 218 715, particularly the compounds of formula I

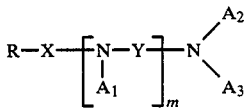

I in which

R is $C_{12-30}$ alkyl or alkenyl

X is a direct bond or —CO—

Y is $C_2$ or $C_3$ alkylene each of $A_1$, $A_2$ and $A_3$ is independently selected from the class consisting of polyethylene oxide chains and poly(ethylene oxide/$C_3$ or $C_4$ alkylene oxide)chains, the total sum of the ethylene oxide units in all three chains being from 3 to 200 and the total sum of the $C_3$ or $C_4$ alkylene oxide units in all three chains being up to 100, and m is 0 or an integer from 1 to 6, and their quaternization products, whereby the compounds may also contain up to a total of 5 styrene-oxy groups per molecule;

b. acid esters of polybasic acids which contain as an ester group the residue of a polyglycol ether derivative, containing an average of 10 to 100 ethylene-oxy units, of at least one primary fatty monoamine containing an aliphatic hydrocarbon radical having 12 to 24 carbon atoms, particularly compounds of formula II

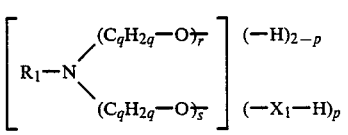

II in which $R_1$ is $C_{12-24}$ alkyl or alkenyl $X_1$ is the anion of a polybasic acid, r and s represent whole numbers the sum of which is 10 to 100, q is 2, 3 or 4 and p is 1 or 2, and their protonation and quaternization products.

In the compounds of formula I, R is preferably $C_{16-22}$ alkyl or alkenyl, X is preferably a direct bond and m is preferably 0, 1 or 2. Preferred compounds of formula I are fatty amines or fatty diamines ethoxylated with a total of 10 to 120 mols ethylene oxide or alkoxylated with a total of 1 to 20 mols propylene oxide and 10 to 40 mols ethylene oxide per molecule. When the compounds of formula I also comprise styrene-oxy groups, they preferably contain 1 or 2 such groups, which are preferably added to the molecule before the ethylene-oxy or propylene-oxy groups.

Suitable quaternization agents for the compounds of formula I or II are for example dimethylsulphate, methyl chloride, benzyl chloride etc. Depending on the amount of quaternization agent used, it is possible to quaternize one or several or all of the basic nitrogen atoms.

In the compounds of formula II, $R_1$ is preferably $C_{16-24}$ alkyl or alkenyl and the sum r and s is preferably 10 to 70. Preferred esters of formula II are sulphuric acid esters or sulphuric acid half esters, more preferably the latter. Particularly preferred sulphuric esters and half esters are those containing from 15 to 25 ethylene-oxy groups per molecule. Compounds of formula II are preferably quaternized. $X_1$ is preferably —$SO_3M$ where M is hydrogen, sodium, potassium, ammonium or substituted ammonium, e.g. ammonium substituted by up to three $\beta,\delta$- or $\omega$-hydroxy-$C_{2-4}$alkyl groups.

Mixtures of cationic dyeing assistants can also be used in the dyeing process of the invention.

Anionic dyeing assistants which are suitable according to the invention are advantageously those which neutralize or counteract the action of the cationic dyeing assistant, thus releasing the dyestuff from the complex formed with the cationic dyeing assistant. Examples of suitable anionic dyeing assistants include $C_{1-12}$ alkyl $C_{6-12}$ arylsulphonic acids, $C_{4-12}$ alkanesulphonic acids, aminoalkylsulphonic acid amides of $C_{14-24}$ fatty acids, sulphonated $C_{14-24}$ fatty acids and esters thereof, e.g. sulphonation products of oleic, elaidic or ricinoleic acid and their esters, especially $C_{1-6}$ alkyl esters, for example methyl, ethyl, propyl or butyl ester, or the glycerine ester of these fatty acids, for example castor oil, sulphuric acid half esters of long chain ethoxylated fatty alcohols or fatty acids, alkyl phosphoric acid esters or half esters, alkyl polyglycol ether phosphoric acid esters e.g. tri $C_{1-10}$alkyl or $C_{2-6}$alkoxy-$C_{2-4}$alkyl phosphate, and condensation products of naphthalenesulphonic acids with formaldehyde or a compound liberating formaldehyde.

Preferred anionic dyeing assistants suitable for the process of the invention are for example:

a. Aromatic sulphones which contain at least one sulphonic acid group or salt form thereof bound to a phenyl ring and obtainable by sulphonation with sulphuric acid of at least one of starting components comprising a component (i) comprising at least one aromatic phenolic compound containing from 6 to 20 carbon atoms and having at least one hydroxy group bound to a phenyl ring, and a component (ii) comprising at least one aromatic non-phenolic compound containing from 6 to 20 carbon atoms, and condensing the resulting sulphonation product together with any unsulphonated components (i) and (ii), e.g. as disclosed in U.S. Pat. Nos. 3,536,438, 3,538,151 and 3,888,913 the disclosure of which being incorporated herein by reference. Particularly preferred sulphones are sulphonic acids of ditolylether sulphones as disclosed in U.S. Pat. No. 4,386,037, the disclosure of which being incorporated herein by reference;

b. Compounds of formula III

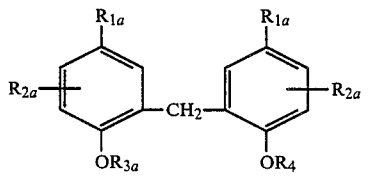

III in which each $R_{1a}$, independently, is $C_{8-12}$ alkyl, each $R_{2a}$, independently is hydrogen or —$SO_3R_6$, $R_{3a}$ is —(—A—O—)$_k$—$R_5$ where each A is —$C_2H_4$—, —$C_3H_6$— or —$C_4H_8$—, R4 is —(—B—O—)$_n$—$R_5$ where each B is —$C_2H_4$—, —$C_3H_6$— or —$C_4H_8$— each $R_5$ is hydrogen or —$SO_3R_6$, provided that at least one $R_5$ is —$SO_3R_6$, each $R_6$ is hydrogen, an alkali metal, an equivalent of an alkaline earth metal, ammonium or substituted ammonium, k is 1, 2 or 3, and n is 0, 1 or 2 the total sum k+n being at most 4, $R_5$ in $R_4$ being hydrogen and k being 1 when n=0, and both $R_{2a}$'s being hydrogen when only one group $R_5$ is —$SO_3R_6$ and n=1 or 2, e.g.as disclosed in U.S. Pat. Ser. No. 06/834 179, the disclosure of which being incorporated herein by reference.

c. Condensation products of naphthalene sulphonic acids with formaldehyde or a compound liberating formaldehyde; and d. Sulphonated castor oil.

Preferred compounds of formula III are those in which the $R_{1a}$'s are nonyl, one $R_{2a}$ is hydrogen and the other is —$SO_3R_6$, $R_{3a}$ is $$(-\underset{\underset{CH_3}{|}}{CH}-CH_2-O)_k-R_5$$

where $R_5$ is —$SO_3R_6$, $R_4$ is —(—B—O—)$_n$—$R_5$ where n=0 and $R_5$ is hydrogen, the $R_6$'s are hydrogen, sodium, potassium, ammonium or monoethanolammonium and k is 1.

Mixtures of anionic dyeing assistants can also be used.

Suitable non-ionic dyeing assistants include polyglycol ethers of $C_{10-24}$ fatty alcohols and of phenols substituted by one or more alkyl groups containing a total of 4 to 16 alkyl carbon atoms. By polyglycol is meant the addition of ethylene oxide or ethylene oxide and propylene oxide, preferably the former. Preferred non-ionic dyeing assistants are the addition products of 15 to 120, particularly 25 to 120 ethylene-oxy groups to $C_{12-22}$ fatty alcohols and the addition products of 4-10 ethylene-oxy groups to ($C_{6-14}$ mono- or di-alkyl) phenols. The fatty residue of the alcohols may be saturated or unsaturated alkyl or alkenyl or a mixture of both.

According to the invention, the cationic dyeing assistant is advantageously used in an amount of from 0.1 to 2% by weight based on the weight of the textile substrate to be treated; the anionic dyeing assistant added to the dyeing liquor in the second step of the process is conveniently used in an amount of from 0.1 to 1% by weight based on the weight of the textile substrate.

When a non-ionic dyeing assistant is further admixed either with the cationic or anionic dyeing assistant, it is preferably used in an amount corresponding to the amounts indicated above for the cationic or anionic dyeing assistant, respectively.

According to the invention, the cationic dyeing assistant is advantageously added to the dyeing liquor at the beginning of the dyeing, particularly before the temperature is raised to the dyeing temperature, e.g. while the dyeing liquor is at a temperature of about 20° to 50° C. Preferably the cationic dyeing assistant (and the non-ionic dyeing assistant when used) is added to the dyeing liquor at the same time as the dyestuffs. The temperature of the dyeing liquor is then raised to the desired dyeing temperature at a suitable heating rate.

In addition to the dyestuffs and the cationic dyeing assistant (and optionally a non-ionic dyeing assistant), further conventional additives for dyeing polyamides may be added to the dyeing liquor, for example an inorganic acid such as sulphuric acid or phosphoric acid, or an organic acid, advantageously a lower aliphatic carboxylic acid such as formic, acetic or oxalic acid. The acids are mainly used to set the pH of the dyeing liquors within the range 4–6, preferably close to the isoelectric point in the case of dyeing wool fibres. Acid generators may be used when synthetic polyamides are dyed.

The dyeing liquor may also contain salts, in particular ammonium or alkali metal salts, for example ammonium sulphate or sodium acetate, chloride or sulphate, preferably sodium sulphate. These salts are preferably used in an amount of 0.1 to 10% by weight based on the weight of the textile substrate.

The dyeing liquors may also contain further additives such as wool-protecting agents, wetting agents or defoamers.

The goods to liquor ratio can vary within a wide range, advantageously from 1:5 to 1:40, preferably 1:8 to 1:25.

According to the invention, dyeing may be performed at the boil at 95°–105° C. as well as at a lower temperature within the range of 60° to 95° C., preferably 80° to 90° C. for dyeing wool.

When the desired dyeing temperature is reached and, while dyeing is continued at the same temperature, the dyestuff uptake comes to an equilibrium and the dyestuffs do no longer exhaust in a substantial amount. At this stage, only a partial exhaustion of the dyebath, e.g. <95%, is reached and the so-called migration phase takes place. The heating conditions, the dyestuffs and the additives are preferably selected to obtain a first exhaustion of the dyeing liquor of 70–95%, as can be determined by conventional methods, for example by colorimetric methods. The migration phase is advantageously carried out at the dyeing temperature within a period of 15 to 60 minutes, preferably 15 to 45 minutes, more particularly 15 to 35 minutes; its duration is preferably regulated depending on various parameters such as the thickness of the fibre substrate, the type of dyeing machine used, the dyestuffs and the additives selected, in order to obtain the desired dyestuff diffusion and penetration. According to the invention, when the dyestuff diffusion and penetration is sufficient, as can be determined by conventional methods, e.g. by sampling, the anionic dyeing assistant is then added to the dyeing liquor, optionally in admixture with a non-ionic dyeing assistant. The addition of the dyeing assistant in the second step of the process in accordance with the invention, may be carried out in a single or several portions or metered in according to a linear or a progressive function, e.g. as disclosed in U.S. Pat. No. 4,629,465. The addition may be performed either at the same temperature as the first dyeing step (isothermic dyeing) or at a higher or lower temperature than that of the first step, e.g. at a temperature of from 40°–60° C. In the latter case, the dyeing liquor is preferably cooled to the desired temperature before adding the second dyeing assistant. As it will be appreciated, a second dyeing process step takes place in the presence of the anionic dyeing assistant, to complete the exhaust rate of the dyeing liquor. Depending on the dyeing conditions and the assistants selected, the dyebath may be exhausted to a rate as close as possible to 100%.

The second dyeing step may generally be shorter than the first dyeing step; it usually corresponds to ¼ of the dyeing period necessary for the first step (heating and migration). Typically, the second dyeing step is carried out between 10 and 40 minutes, preferably 10 to 30 minutes.

The dyed fibre substrate is finished at the end of the second dyeing step, in accordance with conventional methods.

Anionic dyestuffs suitable for the dyeing process of the invention include the anionic dyestuffs used for dyeing natural and synthetic polyamides, preferably 1:1 or 1:2 metal complex dyestuffs containing water-solubilizing and/or sulphonic acid groups or which are free from such groups, acid milling dyestuffs, acid dyestuffs with one or more sulphonic acid groups (in free or salt form), and reactive dyestuffs including metal complex dyestuffs containing a fibre-reactive group. Particularly preferred dyestuffs for dyeing wool are mono- or disulphonated acid dyestuffs having a build-up power on wool of from 90 to 98% at pH 4.5 and a migrating ability on wool of from 25 to 40% at pH 4.5, e.g., as disclosed in U.S. Pat. No. 4,622,045.

The process of the invention is particularly suitable for trichromatic dyeing.

Suitable fibre substrate which may be dyed according to the invention include those comprising natural polyamides such as wool or silk, synthetic polyamides such as the various types of nylon and their blends, optionally with further natural or synthetic fibres, e.g. polyester, cellulose, or polyacrylonitrile. The wool fibres can be natural wool, chlorinated wool, carbonized wool as well as shrink proofed wool, e.g., Hercosett$^R$ or Basolan$^R$ DC shrink proofed wool.

The fibre substrate can be dyed at various stages in processing, for example as loose material, tops, yarn and piece goods, e.g. woven, knitted or fully fashioned articles.

A preferred embodiment of the invention is dyeing wool fibres, more preferably at a temperature of from 80°–90° C.

Particularly preferred cationic dyeing assistants are the polyalkoxylated fatty amines and diamines as disclosed above; naphthalene sulphonic acids/formaldehyde condensation products, especially dinaphthylmethane disulphonic acids are particularly preferred for the second dyeing step.

According to the dyeing process of the invention, the fibre substrate is submitted to a first dyeing step with partial exhaustion of the dyeing liquor, which dyeing step comprises a regulated migration step, and then to a second dyeing step to complete the dyebath exhaustion. The dyeing process of the invention gives level dyeings with good fastness properties and a good dyeing liquor exhaustion rate. When wool is dyed at a temperature below the boil, the same good results are obtained with a fibre-preserving action.

The following examples illustrate the invention without limiting its scope. The percentages are by weight and the temperature are in degrees Centigrade.

EXAMPLE 1

100 Parts wool yarn are introduced in a dyebath at 40° containing 2000 parts water 0.5 parts cationic dyeing assistant based on the quaternized reaction product of 2 mols aminosulphonic acid with tallow fatty amine ethoxylated with 20 mols ethylene oxide 0.5 parts cationic dyeing assistant based on the quaternized addition product of 100 mols ethylene oxide to aminopropyl tallow amine 1.5 parts of the dyestuff mixture comprising
- 85.0 parts of the dyestuff C.I. Acid Red 404
- 15.0 parts of the dyestuff C.I. Acid Red 399, and 2 parts sodium acetate.

The dyebath is adjusted with acetic acid to a pH of 4.8 and then heated to 100° C. within 30 minutes. Dyeing is carried out for 30 minutes at this temperature. Thereafter 0.8 parts of dinaphthylmethane disulphonic acid is added by linear metering to the dyebath in the course of 15 minutes. The dyebath is then cooled to 60° C. and the wool yarn is rinsed and dried.

The resulting wool dyeings are surface and fibre level; they exhibit an excellent dye penetration into the fibre and good all-round fastness properties.

EXAMPLE 2

100 Parts wool yarn are introduced in a dyebath at 40° containing 2000 parts water
5 parts sodium sulphate (calc.)
0.5 parts cationic dyeing assistant based on a quaternized addition product of 10 mols propylene oxide and 15 mols ethylene oxide to tallow amino propyl amine
0.7 parts of the dyestuff C.I. Acid Orange 67
1 part of the dyestuff C.I. Acid Red 336
0.5 parts of the dyestuff C.I. Acid Blue 126
and adjusted to pH 5 with 1 part acetic acid.

The whole is heated to 100° over a period of 30 minutes.

After dyeing for 30 minutes at 100°, 0.5 parts of an anionic dyeing assistant based on dinaphthylmethane disulphonic acid are added to the dyebath within 15 minutes and dyeing is further carried on at the boil for 5 minutes. The dyebath is then cooled to 60° and the wool is rinsed and dried.

The resulting wool dyeings are level and have good all-round fastness properties. Good dyestuff penetration is obtained.

EXAMPLE 3

100 Parts wool are introduced in a dyebath at 40° containing 2000 parts water
10 parts sodium sulphate (calc.)
0.5 parts of the cationic dyeing assistant of Example 2
0.7 parts of the dyestuff C.I. Acid Orange 67
1 part of the dyestuff C.I. Acid Red 336 and
0.5 parts of the dyestuff C.I. Acid Blue 126.
and adjusted to pH 4.5 with acetic acid.

The temperature of the dyebath is raised to 80° and after 30 minutes heating at 80°, there are added 0.5 parts of dinaphthylmethane disulphonic acid to the dyebath. Dyeing is continued for a further period of 30 minutes. After cooling, the wool is rinsed and dried.

There is obtained a level brown wool dyeing with good fastness properties and dyestuff penetration.

EXAMPLE 4

100 parts PA 6 knitted goods are introduced at 40° in a dyebath containing 2000 parts water
0.81 parts of the dyestuff C.I. Acid Orange 127
0.13 parts of the dyestuff C.I. Acid Red 336
0.10 parts of the dyestuff C.I. Acid Blue 350
2 parts cationic dyeing assistant based on the quaternized addition product of 100 mols ethylene oxide to aminopropyl tallow amine, and
4 parts sodium dihydrogenophosphate and 1 part disodium hydrogenophosphate (to obtain pH 6).

The dyebath is then heated to 98° within 30 minutes. Dyeing is continued at 98° for 30 minutes until the desired dyestuff migration and distribution level is reached. Thereafter 0.5 parts of dinaphthylmethane disulphonic acid is metered to the dyebath in the course of 20 minutes and dyeing is continued at 98° for 10 minutes to complete dybath exhaustion. Finally the dyebath is cooled to 80° within 20 minutes and the goods are rinsed and dried.

An orange level dyeing with good penetration at the crossing points of the fibres is thus obtained with nearly full dyebath exhaustion.

What is claimed is:

1. A process for dyeing a textile substrate comprising synthetic or natural polyamide fibres with anionic dyestuffs, comprising the steps of (i) bringing the polyamide fibres into contact with an aqueous dyeing liquor which contains, in addition to one or more anionic dyestuffs, a cationic dyeing assistant which is capable of forming an addition product with the anionic dyestuff and which has a retarding action on the anionic dyestuff, and dyeing the polyamides fibres in said dyeing liquor at a temperature of from 60° to 105° C., and (ii) adding an anionic dyeing assistant to the dyeing liquor 15 to 60 minutes after reaching the dyeing temperature and continuing the dyeing to complete the dye exhaustion, said cationic dyeing assistant being selected from the group consisting of compounds of formula I

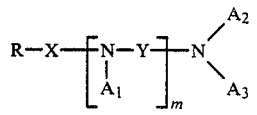

I in which

R is $C_{12-30}$ alkyl or alkenyl
X is a direct bond or —CO—
Y is $C_2$ or $C_3$ alkylene each of $A_1$, $A_2$ and $A_3$ is independently selected from the class consisting of polyethylene oxide chains and poly(ethylene oxide/$C_3$ or $C_4$ alkylene oxide) chains, the total sum of the ethylene oxide units in all three chains being from 3 to 200 and the total sum of the $C_3$ or $C_4$ alkylene oxide units in all three chains being up to 100, and m is 0 or an integer from 1 to 6,
which compounds may also contain up to a total of 5 styrene-oxy groups distributed through the chain $A_1$ and/or $A_2$ and/or $A_3$ and their quanternization products; and compounds of formula II

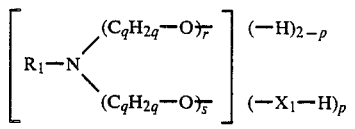

II in which $R_1$ is $C_{12-24}$ alkyl or alkenyl
$X_1$ is the anion of a polybasic acid,
r and s represent whole numbers the sum of which is 10 to 100,
q is 2, 3 or 4, and
p is 1 or 2, and their protonation and quaternizaiton products.

2. A process according to claim 1 wherein the cationic dyeing assistant is added to the dyeing liquor before the temperature is raised to the dyeing temperature.

3. A process according to claim 1 wherein the dyeing is continued for 10 to 40 minutes after the addition of the anionic dyeing assistant.

4. A process according to claim 1 wherein the compounds of formula I are compounds in which R is $C_{16-22}$-alkyl or alkenyl, X is a direct bond and m is 0, 1 or 2 and which are ethoxylated with a total of 10 to 120 mols ethylene oxide or alkoxylated with a total of 1 to 20 mols propylene oxide and 10 to 40 mols ethylene oxide per molecule and, the compounds of formula II are sulphuric acid esters or half esters in which $R_1$ is $C_{16-24}$alkyl or alkenyl and the sum of r and s is 10 to 70.

5. A process according to claim 1, wherein the anionic dyeing assistant is selected from the group consisting of $C_{1-12}$alkyl$C_{6-12}$ arylsulphonic acids, $C_{4-12}$alkanesulphonic acids, aminoalkylsulphonic acid amides of $C_{14-24}$ fatty acids, sulphonated $C_{14-24}$ fatty acids and esters thereof, sulphuric acid half esters of long chain ethoxylated fatty alcohols or fatty acids, alkyl phosphoric acid esters or half esters, alkylpolyglycol ether phosphoric acid esters and condensation products of naphthalene-sulphonic acids with formaldehyde or a formaldehyde liberating compound.

6. A process according to claim 1 wherein the anionic dyeing assistant is selected from a. aromatic sulphones which contain at least one sulphonic acid group or salt form thereof bound to a phenyl ring and which are obtainable by sulphonation with sulphuric acid of at least one of starting components comprising a component (i) comprising at least one aromatic phenolic compound containing from 6 to 20 carbon atoms and having at least one hydroxy group bound to a phenyl ring, and a component (ii) comprising at least one aromatic non-phenolic compound containing from 6 to 20 carbon atoms, and condensing the resulting sulphonation product together with any unsulphonated components (i) and (ii), b. compounds of formula III

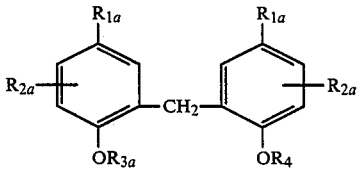

III in which each $R_{1a}$, independently, is $C_{8-12}$ alkyl, each $R_{2a}$, independently is hydrogen or $—SO_3R_6$, $R_{3a}$ is $—(—A—O—)_k—R_5$ where each A is $—C_2H_4—$, $—C_3H_6—$ or $—C_4H_8—$, $R_4$ is $—(—B—O—)_n—R_5$ where each B is $—C_2H_4—$, $—C_3H_6—$ or $—C_4H_8—$ each $R_5$ is hydrogen or $—SO_3R_6$, provided that at least one $R_5$ is $—SO_3R_6$, each $R_6$ is hydrogen, an alkali metal, an equivalent of an alkaline earth metal, ammonium or substituted ammonium, k is 1, 2 or 3, and n is 0, 1 or 2, the total sum k+n being at most 4, $R_5$ in $R_4$ being hydrogen and k being 1 when n=0, and both $R_{2a}$'s being hydrogen when only one group $R_5$ is $—SO_3R_6$ and n=1 or 2, c. condensation products of naphthalene sulphonic acids with formaldehyde or a compound liberating formaldehyde; and d. sulphonated castor oil.

7. A process according to claim 1, wherein a nonionic dyeing assistant is added either to the cationic dyeing assistant or to the anionic dyeing assistant or both.

8. A process according to claim 1, wherein the cationic dyeing assistant is used in an amount of from 0.1 to 2% based on the weight of the textile substrate.

9. A process according to claim 1, wherein the anionic dyeing assistant is used in an amount of from 0.1 to 1% based on the weight of the textile substrate.

10. A process according to claim 1, in which the anionic dyeing assistant is added to the dyeing liquor 15 to 45 minutes after reaching the dyeing temperature.

11. A process according to claim 1, in which the anionic dyestuff is selected from the group consisting of 1:1 or 1:2 metal complex dyestuffs milling dyestuffs, acid dyestuffs with one or more sulphonic acid groups (in free or salt form), and reactive dyestuffs.

12. A process according to claim 1, in which the polyamide fibres comprise wool.

13. A process according to claim 8 wherein the anionic dyeing assistant is used in an amount of from 0.01 to 1% based on the weight of the textile substrate.

14. A process according to claim 12 wherein the dyestuff is a mono- or disulphonated acid dyestuff having a build-up power on wool of from 90 to 98% at pH 4.5 and a migrating ability on wool of from 25 to 40% at pH 4.5.

15. A process according to claim 4 wherein the anionic dyeing assistant is selected from the group consisting of $C_{1-12}$alkyl$C_{6-12}$ arylsulphonic acids, $C_{4-12}$alkanesulphonic acids, aminoalkylsulphonic acid amides of $C_{14-24}$ fatty acids, sulphonated $C_{14-24}$ fatty acids and esters thereof, sulphuric acid half esters of long chain ethoxylated fatty alcohols or fatty acids, alkyl phosphoric acid esters or half esters, alkylpolyglycol ether phosphoric acid esters and condensation products of naphthalene-sulphonic acids with formaldehyde or a formaldehyde liberating compound.

16. A process according to claim 4 wherein the anionic dyeing assistant is selected from a. aromatic sulphones which contain at least one sulphonic acid group or salt form thereof bound to a phenyl ring and which are obtainable by sulphonation with sulphuric acid of at least one of starting components comprising a component (i) comprising at least one aromatic phenolic compound containing from 6 to 20 carbon atoms and having at least one hydroxy group bound to a phenyl ring, and a component (ii) comprising at least one aromatic non-phenolic compound containing from 6 to 20 carbon atoms, and condensing the resulting sulphonation product together with any unsulphonated components (i) and (ii), b. compounds of formula III

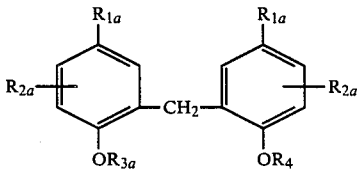

III in which each $R_{1a}$, independently, is $C_{8-12}$ alkyl, each $R_{2a}$, independently is hydrogen or $—SO_3R_6$, $R_{3a}$ is $—(—A—O—)_k—R_5$ where each A is $—C_2H_4—$, $—C_3H_6—$ or $—C_4H_8—$, $R_4$ is $—(—B—O—)_n—R_5$ where each B is $—C_2H_4—$, $—C_3H_6—$ or $—C_4H_8—$ each $R_5$ is hydrogen or $—SO_3R_6$, provided that at least one $R_5$ is $—SO_3R_6$, each $R_6$ is hydrogen, an alkali metal, an equivalent of an alkaline earth metal, ammonium or substituted ammonium, k is 1, 2 or 3, and n is 0, 1 or 2, the total sum k+n being at most 4, $R_5$ in $R_4$ being hydrogen and k being 1 when n=0, and both $R_{2a}$'s being hydrogen when only one group $R_5$ is $—SO_3R_6$ and n=1 or 2, c. condensation products of naphthalene sulphonic acids with formaldehyde or a compound liberating formaldehyde; and d. sulphonated castor oil.

17. A process according to claim 5 wherein the cationic dyeing assistant is added to the dyeing liquor before the temperature is raised to the dyeing temperature.

18. A process according to claim 5 wherein the cationic dyeing assistant is used in an amount of from 0.1 to 2% and the anionic dyeing assistant is used in an amount of 0.1 to 1%, based on the weight of the textile substrate.

19. A process according to claim 6 wherein, in the compounds of formula III, each $R_{1a}$ is nonyl, one $R_{2a}$ is hydrogen and the other is $—SO_3R_6$, $R_3$ is $$(—\underset{\substack{|\\ CH_3}}{CH}—CH_2—O)_k—R_5$$

where $R_5$ is $—SO_3R_6$, $R_4$ is hydrogen, the $R_6$'s are hydrogen, sodium, potassium, ammonium or monoethanolammonium and k is 1.

20. A process according to claim 6 wherein the cationic dyeing assistant is added to the dyeing liquor before the temperature is raised to the dyeing temperature.

21. A process according to claim 6 wherein the cationic dyeing assistant is used in an amount of from 0.1 to 2% and the anionic dyeing assistant is used in an amount of 0.1 to 1%, based on the weight of the textile substrate.

22. A process according to claim 15 wherein the cationic dyeing assistant is added to the dyeing liquor before the temperature is raised to the dyeing temperature and wherein the cationic dyeing assistant is used in an amount of from 0.1 to 2% and the anionic dyeing assistant is used in an amount of 0.1 to 1%, based on the weight of the textile substrate.

23. A process according to claim 16 wherein the cationic dyeing assistant is added to the dyeing liquor before the temperature is raised to the dyeing temperature and wherein the cationic dyeing assistant is used in an amount of from 0.1 to 2% and the anionic dyeing assistant is used in an amount of 0.1 to 1%, based on the weight of the textile substrate.

24. A process according to claim 17 wherein the cationic dyeing assistant is used in an amount of from 0.1 to 2% and the anionic dyeing assistant is used in an amount of 0.1 to 1%, based on the weight of the textile substrate.

25. A process according to claim 19 wherein the cationic dyeing assistant is added to the dyeing liquor before the temperature is raised to the dyeing temperature and wherein the cationic dyeing assistant is used in an amount of from 0.1 to 2% and the anionic dyeing assistant is used in an amount of 0.1 to 1%, based on the weight of the textile substrate.

26. A process according to claim 20 wherein the cationic dyeing assistant is used in an amount of from 0.1 to 2% and the anionic dyeing assistant is used in an amount of 0.1 to 1%, based on the weight of the textile substrate.

27. A process according to claim 22 wherein the anionic dyeing assistant is a naphthalene sulphonic acid/formaldehyde condensation product.

28. A process according to claim 23 wherein the anionic dyeing assistant is a naphthalene sulphonic acid/formaldehyde condensation product.

29. A process according to claim 1 wherein the anionic dyeing assistant is added after the dyeing liquor has exhausted to an extent of 70–95%.

30. A process according to claim 5 wherein the anionic dyeing assistant is added after the dyeing liquor has exhausted to an extent of 70–95%.

31. A process according to claim 6 wherein the anionic dyeing assistant is added after the dyeing liquor has exhausted to an extent of 70–95%.

32. A process according to claim 22 wherein the anionic dyeing assistant is added after the dyeing liquor has exhausted to an extent of 70–95%.

33. A process according to claim 23 wherein the anionic dyeing assistant is added after the dyeing liquor has exhausted to an extent of 70–95%.

34. A process according to claim 13, wherein the anionic dyeing assistant is selected from the group consisting of $C_{1-12}$ alkyl$C_{6-12}$ arylsulphonic acids, $C_{4-12}$ alkanesulphonic acids, aminoalkylsulphonic acid amides of $C_{14-24}$ fatty acids, sulphonated $C_{14-24}$ fatty acids and esters thereof, sulphuric acid half esters of long chain ethoxylated fatty alcohols or fatty acids, alkyl phosphoric acid esters or half esters, alkylpolyglycol ether phosphoric acid esters and condensation products of naphthalene-sulphonic acids with formaldehyde or a formaldehyde liberating compound.

35. A process according to claim 3, wherein the anionic dyeing assistant is selected from a. Aromatic sulphones which contain at least one sulphonic acid group or salt form thereof bound to a phenyl ring and which are obtainable by sulphonation with sulphuric acid of at least one of starting components comprising a component (i) comprising at least one aromatic phenolic compound containing from 6 to 20 carbon atoms and having at least one hydroxy group bound to a phenyl ring, and a component (ii) comprising at least one aromatic non-phenolic compound containing from 6 to 20 carbon atoms, and condensing the resulting sulphonation product together with any unsulphonated components (i) and (ii), b. Compounds of formula III in which each $R_{1a}$, independently, is $C_{8-12}$ alkyl, each $R_{2a}$, independently is hydrogen or $—SO_3R_6$, $R_{3a}$ is $—(—A—O—)_k—R_5$ where each A is $—C_2H_4—$, $—C_3H_6—$ or $—C_4H_8—$, R4 is $—(—B—O—)_n—R_5$ where each B is $—C_2H_4—$, $—C_3H_6—$ or $—C_4H_8—$ each $R_5$ is hydrogen or $—SO_3R_6$, provided that at least one $R_5$ is $—SO_3R_6$, each $R_6$ is hydrogen, an alkali metal, an equivalent of an alkaline earth metal, ammonium or substituted ammonium, k is 1, 2 or 3, and n is 0, 1 or 2 the total sum k+n being at most 4, $R_5$ in $R_4$ being hydrogen and k being 1 when n=0, and both $R_{2a}$'s being hydrogen when only one group $R_5$ is $—SO_3R_6$ and n=1 or 2, c. Condensation products of naphthalene sulphonic acids with formaldehyde or a compound liberating formaldehyde; and d. Sulphonated castor oil.

36. A process for dyeing a textile substrate comprising synthetic or natural polyamide fibres with anionic dyestuffs, comprising the steps of (i) bringing the polyamide fibres into contact with an aqueous dyeing liquor which contains, in addition to one or more anionic dyestuffs, a cationic dyeing assistant which is capable of forming an addition product with the anionic dyestuff and which has a retarding action on the anionic dyestuff, and dyeing the polyamide fibres in said dyeing liquor at a temperature of from 60° to 105° C., and (ii) adding an anionic dyeing assistant to the dyeing liquor 15 to 60 minutes after reaching the dyeing temperature and continuing the dyeing to complete the dye exhaustion, said cationic dyeing assistant being an addition product of a fatty amine, fatty polyamine, fatty acid amide-amine or fatty acid amide-polyamine, in which the fatty residue is saturated or unsaturated, with (1) ethylene oxide or with (2) ethylene oxide and a $C_3$ and $C_4$ alkylene oxide or with (1) or (2) and styrene oxide, which product contains up to 200 ethyleneoxy groups and up to 100 $C_3$ or $C_4$ alkyleneoxy groups and up to 5 styreneoxy groups.

37. A process according to claim 36, wherein the anionic dyeing assistant is selected from the group consisting of $C_{1-12}$alkyl$C_{6-12}$ arylsulphonic acids, $C_{4-12}$alkanesulphonic acids, aminoalkylsulphonic acid amides for $C_{14-24}$ fatty acids, sulphonated $C_{14-24}$ fatty acids and esters thereof, sulphuric acid half esters of long chain ethoxylated fatty alcohols or fatty acids, alkyl phosphoric acid esters or half esters, alkylpolyglycol ether phosphoric acid esters and condensation products of naphthalene-sulphonic acids with formaldehyde or a formaldehyde liberating compound.

38. A process according to claim 37 wherein the cationic dyeing assistant is added to the dyeing liquor before the temperature is raised to the dyeing temperature and wherein the cationic dyeing assistant is used in an amount of from 0.1 to 2% and the anionic dyeing assistant is used in an amount of 0.1 to 1%, based on the weight of the textile substrate.

39. A process according to claim 38 wherein the anionic dyeing assistant is added after the dyeing liquor has exhausted to an extent of 70–95%.

40. A process according to claim 39 wherein the polyamide fibers comprise wool and the dyestuff is a mono- or disulphonated acid dyestuff having a build-up power on wool of from 90 to 98% at pH 4.5 and a migrating ability on wool of from 25 to 40% at pH 4.5.

* * * * *